US011020300B2

(12) United States Patent
Wiewiura

(10) Patent No.: US 11,020,300 B2
(45) Date of Patent: Jun. 1, 2021

(54) TOILET SAFETY ARM ACCESSORY DEVICE

(71) Applicant: Jeff Wiewiura, Farmington Hills, MI (US)

(72) Inventor: Jeff Wiewiura, Farmington Hills, MI (US)

( * ) Notice: Subject to any disclaimer, the term of this patent is extended or adjusted under 35 U.S.C. 154(b) by 0 days.

(21) Appl. No.: 14/684,506

(22) Filed: Apr. 13, 2015

(65) Prior Publication Data

US 2016/0296398 A1 Oct. 13, 2016

(51) Int. Cl.
*A61G 7/10* (2006.01)
*A47K 17/02* (2006.01)

(52) U.S. Cl.
CPC ..... *A61G 7/1007* (2013.01); *A47K 17/026* (2013.01); *A61G 7/1038* (2013.01)

(58) Field of Classification Search
CPC .. A61G 7/1007; A61G 7/1063; A61G 7/1038; A47K 17/026
USPC ..... 4/667
See application file for complete search history.

(56) References Cited

U.S. PATENT DOCUMENTS 2,773,542 A * 12/1956 Chasin ..... A47K 17/026 297/411.36
3,398,410 A * 8/1968 Sparling ..... A47K 17/022 4/254
3,473,174 A * 10/1969 Cool ..... A61G 7/1007 4/667
4,715,069 A * 12/1987 James ..... A47K 17/026 4/254
5,189,739 A * 3/1993 Thierry ..... A47K 13/28 4/237
5,465,744 A * 11/1995 Browning ..... A61G 7/053 135/67
5,509,152 A * 4/1996 Kippes ..... A61G 7/10 135/67

(Continued)

FOREIGN PATENT DOCUMENTS

JP 10201673 A * 8/1998 ..... A47K 17/026
JP 2006102449 A * 4/2006 ..... A47K 17/026
JP 2011078459 A * 4/2011

OTHER PUBLICATIONS

JP2006102449A Translation.*
JP2011078459A Translation.*
JPH10201673A Translation.*

*Primary Examiner* — J C Jacyna
(74) *Attorney, Agent, or Firm* — Aldenbaum Schloff and Bloom PLLC; Jay Schloff

(57) ABSTRACT

A toilet safety arm accessory device comprises a frame that fits around a toilet and a pair of arms coupled thereto allows a user to apply a pulling force onto the device to allow the user to seat him or herself onto a toilet and/or to rise therefrom. The device, which the user grips in lowering and raising himself on and from the toilet. The device may be installed onto a toilet without the use of any tools or hardware and thus does not result in any damage, destruction, or other modification to or of the subject toilet. The toilet safety arm accessory device may also comprise elements of the device that may be added to existing toilet safety devices to allow a user to apply a pulling force and otherwise improve leverage needed to lower him or herself from a toilet and/or raise him or herself from a toilet.

19 Claims, 2 Drawing Sheets

(56) References Cited

U.S. PATENT DOCUMENTS

| | | | | |
|---|---|---|---|---|
| 5,950,258 | A * | 9/1999 | Deyne | A61G 7/10 135/66 |
| 6,598,246 | B1 * | 7/2003 | Shou | A61G 7/1007 297/DIG. 10 |
| 8,286,274 | B1 * | 10/2012 | Manning | A47K 17/026 4/254 |
| 2012/0246813 | A1 * | 10/2012 | Manning | A47K 17/026 4/254 |
| 2013/0232686 | A1 * | 9/2013 | Schwartz | A61G 5/14 4/667 |
| 2014/0338119 | A1 * | 11/2014 | Henshaw | A61G 7/1007 4/667 |
| 2016/0067125 | A1 * | 3/2016 | Splane, Jr. | A61G 5/14 297/250.1 |
| 2019/0290519 | A1 * | 9/2019 | Sjogren | A61G 7/1007 |

* cited by examiner

TOILET SAFETY ARM ACCESSORY DEVICE

CROSS-REFERENCE TO RELATED APPLICATIONS

None.

FIELD OF THE DISCLOSURE

The present disclosure relates to a toilet safety device, and more particularly, to a toilet safety arm accessory device for allowing a user to use a pulling force to lower himself or herself onto and/or rise from a seated position on a toilet.

BACKGROUND

Persons who have either suffered some trauma or whose musculoskeletal structures are frail or weakening, such as the handicapped and the elderly (hereinafter referred to as physically-limited persons), may require special assistance in using restroom facilities. Typically, it is difficult for these persons to use pre-existing, unmodified restroom facilities (i.e., fixtures installed for use by healthy, able-bodied individuals, such as those lacking extra support devices) without help from others. However, many such persons are uncomfortable with having someone assist them in using restroom facilities, or they may simply refuse such help in view of retaining independence and dignity. In the event that any such person attempts to use a pre-existing, unmodified restroom facility, such as a toilet or bath tub, he or she faces a serious risk of injuring himself or herself, for example, by falling or applying too much force onto portions of his or her body.

Certain devices have long been utilized in order to mitigate this risk of injury by persons in need. The most common implement is a grab bar or handle that may be installed onto a nearby wall, a portion of the floor surrounding the subject restroom fixture, or a portion of such fixture itself. These grab bars generally require the use of tools and hardware, such as drills, plates, and screws, to become installed and thus necessitate damaging or causing physical modification to the particular object to which it is installed. Nevertheless, it is apparent that, due to the physical limitations of certain persons, such grab bars are insufficient to provide the support that is needed to properly use restroom facilities on their own. Furthermore, grab bars and other, similar support devices generally known in the art require the user to apply a pushing force onto the bar or device in order to use it, which pushing force serves to impose a greater strain on the user's body.

Accordingly, solutions to this issue have been addressed in various manners. A first such solution is shown in U.S. Pat. No. 5,590,440, which shows an improved grab bar assembly comprising a pivot shaft and coil spring mounted within a housing and coupled with an elongated grab bar. The pivot shaft and coil spring provide for a rotational and pivotal movement of the grab bar relative to the housing, which permits the user to manipulate the physical disposition of the grab bar. In this way, the user can move the grab bar as desired to comfortably position himself or herself for using a subject restroom fixture. However, this solution still requires use of tools and hardware to install, thereby damaging the object upon which it is installed. Further, this solution fails to adequately mitigate the risk of injury to a user when used in connection with certain restroom fixtures, such as toilets, wherein the user needs to use both of his or her hands in order to stabilize himself or herself when using such fixtures, and wherein the user may generally still need to apply a pushing force in order to use this assembly.

A second solution for providing support to a physically-limited person for using a restroom fixture is disclosed in U.S. Pat. No. 8,286,274, which teaches a restroom aid for use with a toilet. This restroom aid comprises a plurality of elongated members and joint pieces capable of being assembled into a frame to be situated about a toilet. Handle-like projections are provided on either side of the frame for the user to grip in seating himself or herself onto the toilet and subsequently rising therefrom, and braces abutting the underside of the toilet's water tank and the sides of the toilet itself help to keep the restroom aid in place during use. Despite the foregoing, though, the structure and placement of the handle-like projections make using any pulling force by the user awkward, and, to the extent that such pulling force can be applied, the fact that the restroom aid lacks any braces on a forward portion of the toilet creates a risk of the structure moving upon such application, which could result in injury to the user.

Thus, while existing solutions show some features for helping a physically-limited person to use a bathroom fixture, such as a toilet, without necessitating further human assistance, various drawbacks, including those mentioned above, remain.

Consequently, there exists a need for a toilet safety arm accessory device that can become installed to an existing toilet without the need for tools or hardware and without damaging the toilet (or to existing toilet safety devices), which permits the user to seat himself or herself onto and subsequently rise from a subject toilet through the application of a pulling force rather than a pushing force, and which includes braces and similar elements for securing its position on a subject toilet upon the application of such pulling force.

SUMMARY OF THE INVENTION

In view of the foregoing disadvantages of the prior art, a toilet safety arm accessory device configured to include all the advantages of the prior art and to overcome the drawbacks inherent therein is provided. It is an object of the present disclosure to provide toilet safety arm accessory device that may be installed onto a subject toilet without the need for tools or hardware and without damaging the toilet and/or surrounding walls, for example. It is further an object of the present disclosure to provide a toilet safety arm accessory device that allows a user to apply a pulling force onto a portion thereof in order to lower himself or herself to a seated position on the subject toilet and/or to raise himself or herself to a standing position therefrom. It is further an object of the present disclosure to provide a toilet safety arm accessory device that includes braces and similar elements for securing its position on the subject toilet upon the application of such pulling force by the user. It is yet another object of the present disclosure to provide for a toilet safety arm accessory device that may be attached to existing toilet safety devices to improve the performance of such safety devices and allow a user to apply a pulling force and otherwise improve leverage needed to lower him or herself from a toilet and/or raise him or herself from a toilet.

In an embodiment, a toilet safety arm accessory device comprises a frame having a lower element and an upper element extending upwardly and outwardly at an acute angle from the lower element with respect to a rear portion of the frame, an adjustable pair of arms coupled to the frame and extending upwardly and outwardly from the lower element towards a forward portion of the frame, and at least one brace piece (also referred to herein as a "rear support leg") coupled to the rear portion of the frame and in communication with a portion of a toilet, wherein a user may apply a pulling force onto at least one arm of the pair of arms in order to lower himself or herself to a seated position on a seat of the toilet, and/or wherein the user may apply a further pulling force onto each such arm in order to raise himself or herself to a standing position. In an alternative embodiment, the coupling of the pair of arms and the frame comprises a toothed gear and a biasing mechanism, wherein the user may apply a pushing force onto each arm of the pair of arms in order to rotatably adjust the angle of the pair of arms relative to the frame. In yet another embodiment, the coupling of the pair of arms and the frame comprises a pivotable coupling and a snap or friction fit that allows the arms to be adjustably but fixedly positioned with respect to the frame and/or a toilet.

In a further embodiment, the upper element and lower element are both parabolic or "U" shaped. In another embodiment, the upper element and lower element each further comprise a padded element. In a further embodiment, the upper element and lower element may adjustably positioned with respect to one another, e.g., the angle between the upper and lower element may be adjusted as may be dictated by size of the particular toilet to which the device is to be installed, or to allow the secure placement of the rear support legs to the toilet. In another further embodiment, each arm of the pair of arms includes a gripping member disposed at a forward portion thereof, which is capable of being gripped by the user. In yet another embodiment, the device may be installed onto the subject toilet without the use of tools and without damaging, destroying, or otherwise modifying any portion of the toilet. In another embodiment, the at least one adjustable rear support leg couples the upper element of the frame to a portion of the toilet. In a further embodiment, a securing strap or linkage (hereinafter referred to as "securing strap") is disclosed as coupling a portion of the at least one rear support leg and an arm of the pair of arms. In another embodiment, the adjustability of the pair of arms and adjustable rear support legs is by way of a telescoping feature or a spring-loaded peg feature. In yet another embodiment, the frame comprises at least one support element coupled to each of the upper element and the lower element.

In yet another embodiment, a toilet safety arm accessory device comprises elements of the device that may be added to existing toilet safety devices for improving those existing devices. In an exemplary embodiment, the elements include arms that may be attached to existing safety device to assist a user by allowing the user to apply a pulling force and otherwise improve leverage needed to lower him or herself from a toilet and/or raise him or herself from a toilet. In another exemplary embodiment, the elements include support elements that may operatively couple the device disclosed herein to existing safety devices such that the stability and security of the attachment of the existing device to the toilet may be improved.

These together with other aspects of the present disclosure, along with the various features of novelty that characterize the present disclosure, are pointed out with particularity in the claims annexed hereto and form a part of the present disclosure. For a better understanding of the present disclosure, its operating advantages, and the specific objects attained by its uses, reference should be made to the accompanying drawings and detailed description in which there are illustrated and described exemplary embodiments of the present disclosure.

DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

The best mode for carrying out the present disclosure is presented in terms of its preferred embodiments, herein depicted in the accompanying figures. The preferred embodiments described herein detail for illustrative purposes are subject to many variations. It is understood that various omissions and substitutions of equivalents are contemplated as circumstances may suggest or render expedient, but are intended to cover the application or implementation without departing from the spirit or scope of the present disclosure.

The terms "a" and "an" herein do not denote a limitation of quantity, but rather denote the presence of at least one of the referenced items.

The present disclosure comprises a toilet safety arm accessory device.

Figure 1:
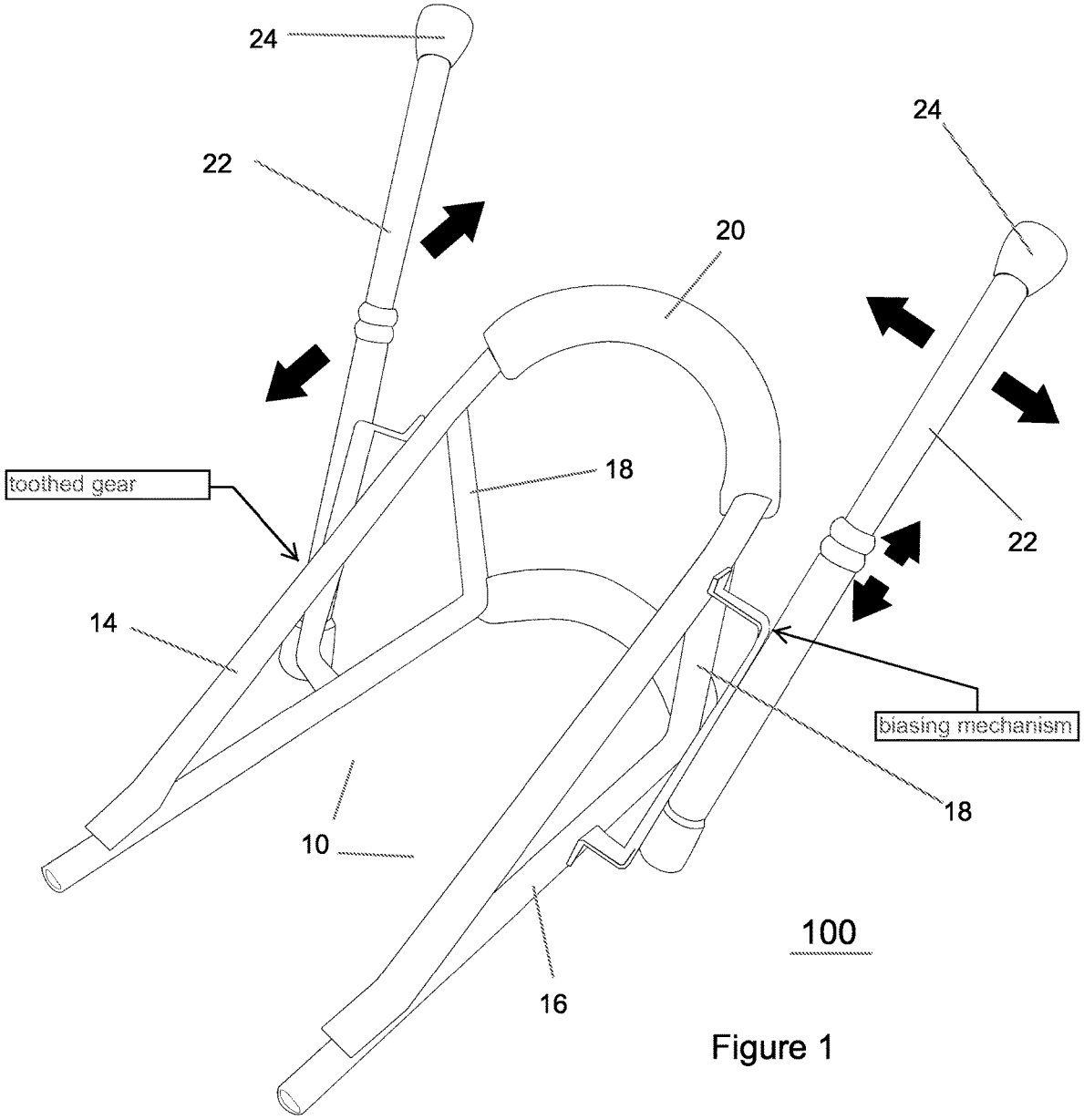
FIG. 1 shows an exemplary depiction of the disclosed toilet safety arm accessory device in accordance with an exemplary embodiment of the present disclosure.
Figure 2:
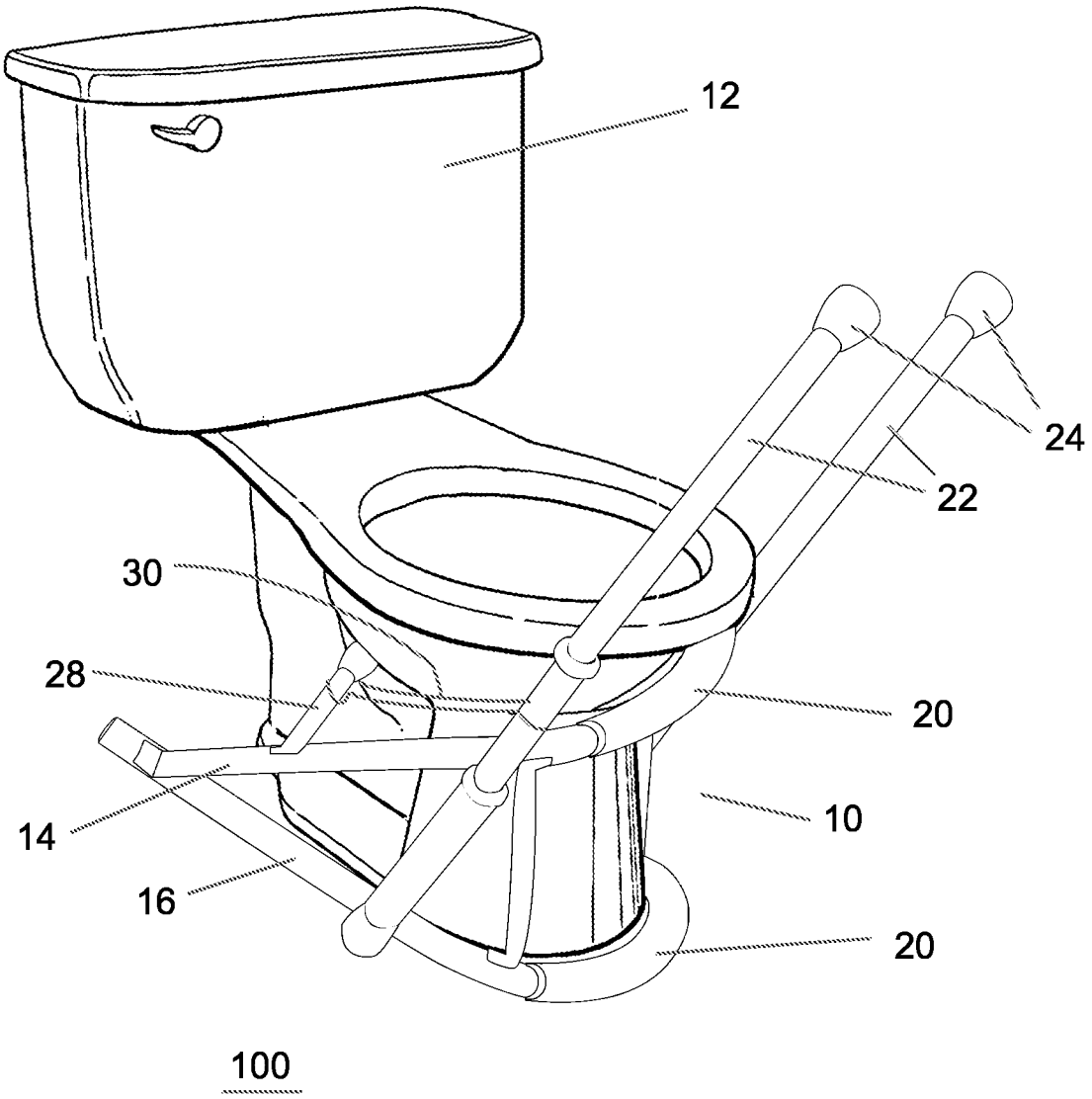
FIG. 2 shows an exemplary depiction of the disclosed toilet safety arm accessory device positioned against a toilet, in accordance with an exemplary embodiment of the present disclosure.

Referring now to FIG. 1 and FIG. 2, a toilet safety arm accessory device is shown at 100 in an embodiment. The device 100 includes a frame 10 that is designed to be in communication with a portion of an existing toilet 12, which toilet 12 would preferably not have any other assist devices (e.g., grab bars or safety handles) installed thereon. The frame 10 is comprised of sturdy materials, such as metal rods, durable plastics (or any other suitable lightweight and resilient material), which will retain rigidity while installed on the subject toilet 12.

The frame 10 is comprised of an upper element 14 and a lower element 16, which are directly coupled to one another at a rear portion of the frame 10. In an embodiment, the coupling of the upper element 14 and lower element 16 is by way of welding. In an alternative embodiment, such coupling is by way of a screw and nut configuration. Regardless of the particular form of coupling, the lower element 16 rests upon the floor, for example, and serves as the support foundation for the device 100, and the upper element 14 extends upwardly and outwardly at an acute angle from the lower element 16 relative to the rear portion of the frame 10 wherein the upper element 14 is coupled to the lower element 16.

In an embodiment wherein the coupling of the upper element 14 and lower element 16 is by way of a screw and nut (or other configuration wherein such elements are not permanently conjoined at static positions), the coupling thereof may allow the user to modify the degree of the angle formed by the upper element 14 with respect to the lower element 16. Such modification would benefit the user wherein the subject toilet 12 is taller or shorter than immediately contemplated by the device 100 (i.e., so that the user may easily and customizably fit the device 100 onto toilets of various sizes). The modification further provides an ability to adjust the upper and lower elements to securely position the at least one rear support leg against a subject toilet in an embodiment where the at least one rear support leg is not adjustable in length.

The frame 10 may further comprise one or more support elements 18 disposed at or near a forward portion thereof. In a preferred embodiment, the frame 10 comprises two support elements 18 wherein one such support element 18 is disposed on either side of the subject toilet 12. The support elements 18 are coupled on a first end to the upper element 14 of the frame 10 and on a second end to the lower element 16 thereof. Coupling of a support element 18 may be accomplished by a screw clamp or other mechanism that permits the upper element 14 or lower element 16 to move freely with respect to the support element 18 (for example, to allow the user to adjust the angle between the upper element 14 and lower element 16 without decoupling the support element 18 from the upper element 14 and/or lower element 16). It will be apparent that the support elements 18 provide additional structural support for retaining the shape and integrity of the device 100, but that the other portions of the device 100 generally provide a sufficient amount of support on their own.

Preferably, each of the upper element 14 and lower element 16 will include a padded element 20 disposed at a portion thereof such that, when the device 100 is installed onto a toilet 12, the padded elements 20 are in communication with a portion of the toilet 12 (generally, a portion of the base or the bowl of the toilet 12). It will be apparent that the padded elements 20 not only prevent the device 100 from scratching or damaging the portions of the toilet 12 to which it makes contact, but also provide additional support (in combination with the frame 10 elements, themselves) for retaining the device 100 in place during use, as will be discussed in greater detail below. The frame 10 preferably comprises a generally parabolic or "U" shape, wherein the forward portion of the frame 10 (i.e., in an embodiment, the portion at which the padded elements 20 are disposed) is the curved portion and the rear portion thereof (i.e., in an embodiment, where the couplings of the upper element 14 and lower element 16 are) features an endpoint.

The device 100 further comprises a pair of arms 22 extending upwardly and outwardly with respect to the frame 10 and, generally, beyond the forward portion of the frame 10. Each of the arms 22 is elongated and capable of being gripped by a user at one or more portions thereof. In an embodiment, each arm of the pair of arms 22 comprises a gripping member 24. In a further embodiment, the gripping members 24 may feature a coating or material attached thereto that better enables or facilitates gripping by a user.

In an embodiment, each arm of the pair of arms 22 is coupled to the frame 10 using the same or a similar form of coupling as used between the upper element 14 and lower element 16 of the frame 10 (such as welding, screw and nut, etc.) Other than the instance of welding, it will be apparent that the coupling may allow adjustable positioning of each arm of the pair of arms 22 with respect to the frame, for example by loosening the screw and nut to allow the arm to be pivoted forward or backward with respect to the frame 10 and thereafter by tightening the screw and nut to allow for secure attachment of the arm to the frame prior to use of the device. In another embodiment, the pair of arms 22 are coupled to the frame 10 such that the positioning of the pair of arms 22 is substantially continuously adjustable with respect to the frame 10. In an embodiment, such adjustable positioning comprises a ball joint disposed on the lower element in which an arm of the pair of arms 22 is received, and which ball joint allows the arm to pivot in at least a forward and backward direction with respect to the frame as well as toward and away from the frame 10. A locking mechanism such as a clip or clips on the upper element 14 may be provided to receive a portion of an arm and retain the arm in a position once the arm has been maneuvered in to a preferred location (of selectable locations) by the user. This embodiment permits the user to rotatably alter the coupling between each arm of the pair of arms 22 and the frame 10, also without requiring the user to first uncouple those elements or even remove the device 100 from a use position. That is, for example, while seated, a user may apply a pushing force to the pair of arms 22 in order to rotate the gear 24, which changes the angle between the pair of arms 22 and the lower element 16. In these various ways, the user may easily and customizably alter the height of the pair of arms 22 (with respect to the lower element 16) as well as the degree of the fixed position of the arms 22 as it relates to the proximity of the toilet, for example, to meet the user's particular arm span and/or comfort in using the device.

In addition to be rotatably customizable to facilitate use by persons with differing arm spans, the pair of arms 22 is also adjustable in length. Each arm of the pair of arms 22 may be set to a user-defined length by way of such adjustment in order to further customize the positioning of the device 100 to a comfortable setting for the user. In an embodiment, such adjustment is by way of a telescoping feature. In an alternative embodiment, such adjustment is by way of a spring-loaded peg feature.

The device 100 further comprises at least one rear support leg 28 (as shown in FIG. 2). A first end of the at least one rear support leg 28 is coupled to the upper element 14 of the frame 10 and a second end thereof is in communication with a portion of the subject toilet 12 and retained in position by way of a friction fit therewith. In a preferred embodiment, the device comprises two such rear support legs 28 wherein one is coupled to each side of the upper element 14. Much like the pair of arms 22, the at least one rear support leg 28 is adjustable in length, which adjustment may be by way of a telescoping feature or a spring-loaded peg feature. Based on any adjustments made to the other components of the device 100, the user may need to adjust the length of the at least one rear support leg 28 in order to create the friction fit of the second end of the at least one rear support leg 28 with respect to the subject toilet 12. In an embodiment, the first end of the at least one rear support leg 28 will be slidably coupled to the upper element 14 of the frame 10, thereby allowing the user to set the position at which the at least one rear support leg 28 contacts the subject toilet 12 (for example, where a subject toilet 12 at which the device 100 will be installed has different dimensions than a previous such subject toilet 12 to which the device 100 has previously been installed). In that angle formed by the the upper element 14 and lower element 16 of the frame 10 may be adjustable, it will be apparent that a user may also manipulate that angle, depending on the configuration of a subject 12, to position the at least one rear support leg 28 nearer to that toilet 12 as necessary.

A securing strap 30 may be included with each at least one rear support leg 28, which securing strap 30 connects a portion of the corresponding rear support leg 28 to the arm of the pair of arms 22 coupled to that side of the frame 10. The securing strap 30 lends additional structural integrity to the device 100 by effectively adding an additional coupling to the connected components. It will be apparent that the securing strap 30 will be sufficiently rigid or otherwise resilient to allow movement of an arm of the pair of arms 22 to translate to movement to a rear support leg 28.

It will be apparent that, despite the various contact points on the subject toilet 12, the device 100 may be installed at such toilet 12 without the use or need of any tools or hardware, such as drills, screws, plates, or the like. That is, and preferably, the contact of any component of the device 100 with any portion of the subject toilet 12 is by way of a friction fit or similar removable attachment; however, it is contemplated that any form of damage-free or destruction-free contact may be used so long as the necessary structural support is retained for the device 100.

In another embodiment, a toilet safety arm accessory device comprises elements of the device that may be added to existing toilet safety devices for improving those existing devices. In an exemplary embodiment, the elements include at least one arm 22 that may be attached to an existing safety device to assist a user by allowing the user to apply a pulling force and otherwise improve leverage needed to lower him or herself from a toilet 12 and/or raise him or herself from a toilet 12. In another exemplary embodiment, the elements include support elements 18 wherein at least one such support element 18 may be disposed on or against a subject toilet 12, and which at least one support element 18 may operatively couple an existing toilet safety device to a subject toilet 12 such that the stability and security of the attachment of the existing device to the toilet may be improved.

In such an embodiment, at least one element of the elements of the toilet safety arm accessory device is attached to a portion of an existing toilet safety device to improve the user's ability to use the existing device, for instance, by being able to exert a pulling force on at least one arm 22 that has been attached to the existing device, or, by providing increased stability to the existing device due to at least one support element 18 that, so attached to an existing toilet safety device, operatively couples the existing safety device to a subject toilet 12 such that the support element 18 directly couples or increases the security of the attachment between the existing toilet safety device and the subject toilet 12.

In use, and upon being installed at a subject toilet, the device disclosed herein (or elements disclosed herein attached to an existing toilet safety device) permits a user to lower himself or herself to a seated position on a seat of the toilet and/or subsequently rise to a standing position therefrom by applying a pulling force, rather than a pushing force, onto the pair of arms. Upon application of such pulling force, the various components of the device that contact the toilet, such as the forward portion of the frame, the brace pieces, and the rear support legs, all transfer a force to the toilet via a friction fit or similar connection in order to retain the device in its use position. By virtue of the device being installed at a toilet without the use of any tools or hardware, in the event that the user wishes to use the device with a different toilet, he or she need only disconnect any components of the device that are in contact with the toilet, which, again, results uninstallation does not result in any damage or destruction to the toilet.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A toilet safety arm accessory device comprising:

a frame having a lower element, an upper element, a forward portion, and a rear portion, said lower element resting upon a surface, said lower element having a parabolic shape, the vertex of said parabolic shape of said lower element being disposed at said forward portion of said frame, said upper element extending upwardly and outwardly at an acute angle from said lower element at an acute angle with respect to said rear portion;

a pair of arms coupled to said frame, said pair of arms extending upwardly and outwardly from said lower element towards said forward portion of said frame, each arm of said pair of arms being adjustable in length and angular position as related to a toilet upon which the device is installed, said angular position adjustment being with respect to the lower element and said length adjustment being with respect to the distance of each arm from the lower element, and said angular position adjustment being without sliding attachment to any other element of the device; and at least one rear support leg coupled to said rear portion of said frame, said at least one rear support leg in communication with a portion of the toilet, wherein when the user applies a pulling force onto each arm of said pair of arms while seated on the toilet in order to raise the user to a standing position from the seat of the toilet.

2. The device of claim 1, wherein at least one of said upper element and said lower element further comprises a padded element.

3. The device of claim 1, wherein at least one arm of said pair of arms includes a gripping member disposed at a forward end thereof, said gripping member capable of being gripped by the user.

4. The device of claim 1, wherein the device may be installed is installable on the toilet without the use of tools and without damaging, destroying, or otherwise modifying any portion of the toilet.

5. The device of claim 1, wherein at least one rear support leg said is adjustable in length, said at least one rear support leg having a first end and a second end, said first end being coupled to said upper element of said frame, said second end being in communication with a portion of the toilet.

6. The device of claim 5, further comprising a securing strap coupling said at least one rear support leg to an arm of said pair of arms.

7. The device of claim 5, wherein said adjustment of said at least one rear support leg is performed by one of telescoping and spring-loaded peg features.

8. The device of claim 1, wherein said adjustment of each arm of said pair of arms is performed by one of telescoping and spring-loaded peg features.

9. The device of claim 1, wherein said frame further comprises at least one support element coupled to each of said upper element and said lower element.

10. A toilet safety arm accessory device comprising:

a frame having a lower element, an upper element, a forward portion, and a rear portion, said lower element resting upon a surface, said lower element having a parabolic shape, the vertex of said parabolic shape of said lower element being disposed at said forward portion of said frame, said upper element extending upwardly and outwardly at an acute angle from said lower element at an acute angle with respect to said rear portion;

a pair of arms coupled to said frame, said pair of arms extending upwardly and outwardly from said lower element towards said forward portion of said frame, each arm of said pair of arms being adjustable in length and degree of angular position as related to a toilet upon which the device is installed, said angular position adjustment being with respect to the lower element and said length adjustment being with respect to the distance of each arm from the lower element, said angular position adjustment being without sliding attachment to any other element of the device, and said coupling of said pair of arms to said frame comprises a toothed gear and a biasing mechanism; and at least one rear support leg coupled to said rear portion of said frame, said at least one rear support leg in communication with a portion of a toilet, wherein when the user applies a pushing force onto each arm of said pair of arms an angle of said pair of arms rotatably adjust relative to said frame via said toothed gear, said biasing mechanism retaining the angle until it is further adjusted, and wherein when the user applies a pulling force onto each arm of said pair of arms while seated on the toilet in order to raise the user to a standing position from the seat of the toilet.

11. The device of claim 10, wherein said upper element is parabolic in shape.

12. The device of claim 10, wherein at least one of said upper element and said lower element further comprises a padded element.

13. The device of claim 10, wherein at least one arm of said pair of arms includes a gripping member disposed at a forward end thereof, said gripping member capable of being gripped by the user.

14. The device of claim 10, wherein the device is installable on the toilet without the use of tools and without damaging, destroying, or otherwise modifying any portion of the toilet.

15. The device of claim 10, wherein said at least one rear support leg is adjustable in length, said at least one rear support leg having a first end and a second end, said first end being coupled to said upper element of said frame, said second end being in communication with a portion of the toilet.

16. The device of claim 15, further comprising a securing strap coupling said at least one rear support leg to an arm of said pair of arms.

17. The device of claim 15, wherein said adjustment of said at least one rear support leg is performed by one of telescoping and spring-loaded peg features.

18. The device of claim 10, wherein said adjustment of each arm of said pair of arms is performed by one of telescoping and spring-loaded peg features.

19. The device of claim 10, wherein said frame further comprises at least one support element coupled to each of said upper element and said lower element.

* * * * *